United States Patent [19]

Mailloux et al.

[11] 3,938,160

[45] Feb. 10, 1976

[54] PHASED ARRAY ANTENNA WITH ARRAY ELEMENTS COUPLED TO FORM A MULTIPLICITY OF OVERLAPPED SUB-ARRAYS

[75] Inventors: Robert J. Mailloux, Wayland; Peter R. Franchi, Winchester, both of Mass.

[73] Assignee: The United States of America as represented by the Secretary of the Air Force, Washington, D.C.

[22] Filed: Aug. 7, 1974

[21] Appl. No.: 495,475

[52] U.S. Cl. ..... 343/778; 343/853; 343/854

[51] Int. Cl.[2] ..... H01Q 3/26

[58] Field of Search..... 343/778, 854, 853

[56] References Cited

UNITED STATES PATENTS 3,392,395 7/1968 Hannan..... 343/853 X

*Primary Examiner*—Paul L. Gensler
*Assistant Examiner*—E. R. LaRoche
*Attorney, Agent, or Firm*—Joseph E. Rusz; Willard R. Matthews, Jr.

[57] ABSTRACT

High gain limited scan operation of phased array antennas is accomplished with microwave circuitry by appropriately coupling the array elements into sub-arrays and establishing a 90° out of phase relationship between even and odd mode power at the aperture of each array element. Even and odd mode power from the feed circuit of each element is coupled to the feed circuit of each nearest adjacent element to form three element overlap sub-arrays in each plane of scan.

4 Claims, 4 Drawing Figures

PHASED ARRAY ANTENNA WITH ARRAY ELEMENTS COUPLED TO FORM A MULTIPLICITY OF OVERLAPPED SUB-ARRAYS

BACKGROUND OF THE INVENTION

This invention relates to phased array antennas, and in particular to means for implementing limited scan operation of that type of antenna with microwave circuitry.

Conventional phased arrays are seldom proposed as antennas for high-gain, limited-scan applications because their required element spacings are small, and the resulting number of elements and phase shifters is excessively large. It has long been recognized, however, that if flat-topped radiation patterns could be synthesized to suppress the grating lobes, arrays of relatively few but larger sub-arrays or elements could be used for these applications. Although several element design approaches have met with reasonable success, allowing spacings up to 0.9λ, much larger spacings would be achievable if overlapped sub-array distribution could be produced.

This approach has in the past been neglected because of the lack of microwave circuits that are capable of effectively achieving the required overlapped sub-array distribution. THe present invention is directed toward providing microwave circuitry and element coupling arrangements that will permit the use of such an approach.

SUMMARY OF THE INVENTION

The invention consists of means for exciting phased array elements to produce relatively narrow and square element radiation patterns. Square element or sub-array patterns can be produced using a special $\sin\mu/\mu$ type aperture distribution. In order to make these element patterns narrow enough for use in a multiple beam or limited scan array, it is required that the aperture distribution corresponding to each set of terminals extend beyond the aperture devoted to a single element or unit cell. This, in the present invention, is accomplished by intercoupling the elements and thus overlapping the effective sub-arrays. The overlapping is done using multi-mode waveguide circuitry which is compact and appropriate to the current state of the art. Each element is coupled by directional couplers to its nearest neighbor elements to form a three element sub-array in each direction of scan.

It is a principal object of the invention to provide a new and improved limited scan phased array antenna.

It is another object of the invention to adapt a phased array antenna to high gain limited scan operation without utilizing an excessively large number of elements and phase shifters.

It is another object of the invention to provide microwave circuitry capable of implementing high gain limited scan operation of phased array antennas.

These, together with other objects, advantages and features of the invention will become more readily apparent from the following detailed description when taken in conjunction with the illustrative embodiment in the accompanying drawings.

DETAILED DESCRIPTION OF THE PREFERRED EMBODIMENT

The invention provides a practical, passive means of tailoring the pattern of a sub-array to achieve limited sector scan with a minimum number of array elements. This is accomplished by synthesizing a square element pattern for array grating lobe suppression.

Figure 1:
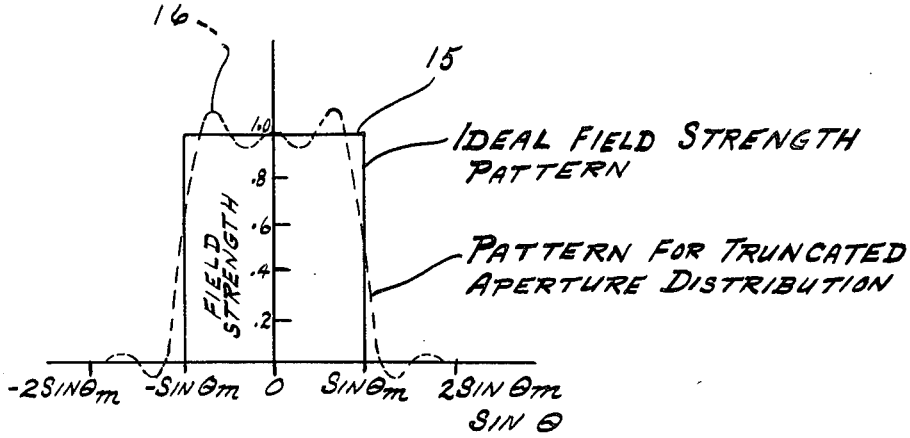
FIG. 1 is a graph showing curves of ideal and approximate flat-topped element patterns.

The desired effect is illustrated in FIG. 1 which shows a flat-topped sub-array pattern in one dimension. Curve 15 represents an ideal field strength pattern and curve 16 represents a pattern for truncated aperture distribution. An array of such sub-arrays can be scanned to the angle $\theta_m$ such that $D \sin \theta_m = 0.5$, where D is the inter-sub-array spacing normalized to wavelength. In this case, a large array with main beam at $\sin \theta = 0.5/D - \sigma$ will have its nearest grating lobe at $\sin \theta = -0.5/D - \sigma$, and all grating lobes will be completely suppressed. The aperture field corresponding to this far field distribution is of the form $$f(x) = \frac{\sin (2\pi x \sin \theta_m)}{(2\pi x \sin \theta_m)},$$

where $x$ is the distance in wavelengths measured from the center of the sub-array. If the maximum ideal spacing $D = 0.5/\sin \theta_m$ is used, then this aperture distribution has zeros at $x = \pm nD$, excluding $n = 0$, and one must include a number of elements in order to reproduce the $f(x)$ distribution faithfully. Thus, each phase shifter must feed a multiplicity of sub-arrays and the sub-arrays can be said to be overlapped. Obviously, the ideal aperture field can be approximate only; it must be truncated and then approximated by realizable distributions at each element. The dashed curve 16 shown in FIG. 1 shows the flat-topped subarray pattern achievable if the $f(x)$ is truncated at $x = \pm 3D$. In this case, 20-dB grating lobe suppression can be obtained for scan out to the angle $$D \sin \theta_m = 0.43.$$

The present invention discloses a technique that allows $f(x)$ to be approximated by higher order even and odd mode distributions in horn apertures so that the element spacings can be made equal to the distance $D$ between sub-arrays.

The motivation for choosing to introduce odd modes into the apertures in this case is that, for maximum spacing, the aperture illumination of the $f(x)$ pattern is predominantly odd at the two elements on either side of center. The technique consists therefore in interconnecting all elements in overlapped sub-arrays of three elements each (nearest neighbor coupling only), so as to produce and control a higher order mode distribution at each element.

The technique allows an element size times scan angle product in the E-plane of approximately $$D \sin \theta_m = 33,$$

using only one-third as many phase shifters for ± 7° scan and one-fourth as many for ± scan as a conventional array with 0.95 λ element spacing.

Figure 2:
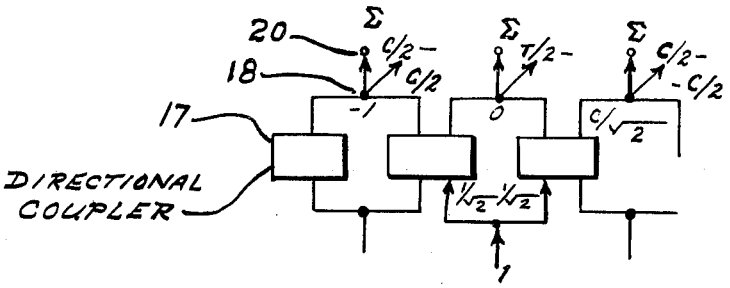
FIG. 2 is a schematic diagram of an overlapped array circuit.

FIG. 2 shows a schematic of the transmission line circuit for overlapping three elements 20 in an array for E-plane scan. Viewed as an overlapped sub-array with only the central element excited, each coupler 17 with coupling coefficient C and transmission coefficient T is excited by in-phase signals with normalized amplitude $1/\sqrt{2}$. The signals coupled into the circuits at left and right are $C/\sqrt{2}$. For symmetric, lossless directional couplers, T can be taken as real, C as imaginary and $/t/^2 + /C/^2 = 1$. At the sum-hybrid port 18, the signals at both the left and right of the central antenna are ½ $C$, and the signal at the difference port is + ½ $C$ for the antenna at left and −½ $C$ for that at right. Since $C$ is imaginary, the sum port signals at the left and right antennas are 90° out of phase with that of the central antenna, and these constitute an error in the approximate $f(x)$ distribution for the sub-array. Fortunately, this error is of little consequence, with the advantage of providing full aperture efficiency at broadside to outweigh its disadvantage.

Figure 3:
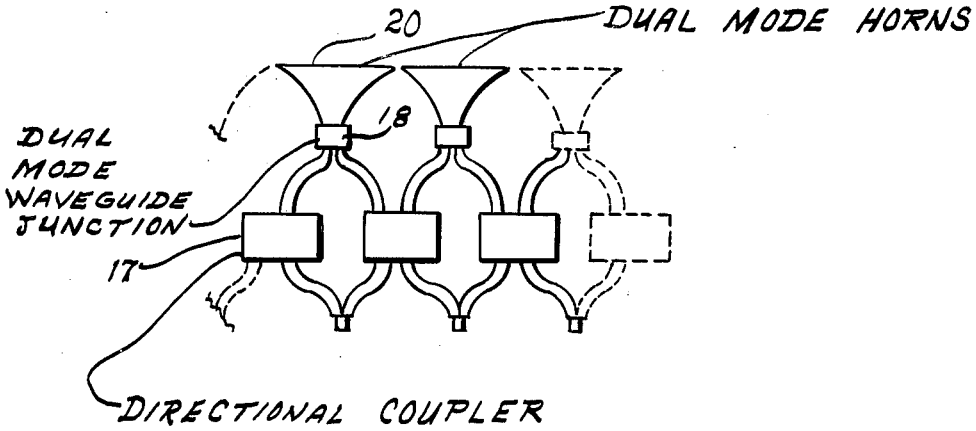
FIG. 3 is a microwave circuit for an overlapped array of horn antennas.

In practice, the sum and difference hybrid shown in FIG. 2 need only be a junction into a dual mode waveguide, as indicated by the dual mode waveguide junction in FIG. 3. Since the modes propagate with different velocities in the horn 20 and dual mode section, its length is chosen to provide an extra 90° delay in the odd-mode path as required for the proper aperture field.

An alternative perspective is obtained by assuming that all of the other array input signals are present. In this case, the central feed point is still excited by the unity signal and the left and right feed points are excited by signals $e^{j\eta}$ and $e^{-j\eta}$, respectively, to form a beam at $\theta = \sin^{-1} \eta/2\pi D$. The sum signal at the central element is $T + C \cos n$ and the difference signal is $\pm jC \sin \eta$, which is real. The extra λ/4 delay makes the difference signal imaginary, as required. A similar combination of signals is present at every antenna and the net result is that only the even mode contributions are present near broadside. Since the two even contributions are 90° out of phase, their power adds to the total input power at broadside. As the array is scanned the odd-mode term with its $\sin \theta$ variation grows.

In order for the odd- and even-mode radiations to cancel one another at any point in space, the odd and even modes must be 90° apart in phase, and with the proper amplitudes. In this case, the odd mode is pure imaginary for the array case, and the even mode has a large real component and a smaller imaginary one, so that complete cancellation cannot take place except at $D \sin \theta = 0.25$, when the cos n component is zero. At other scan points, partial cancellation takes place and the even and odd modes reinforce one another to form a flat-topped active element pattern.

Figure 4:
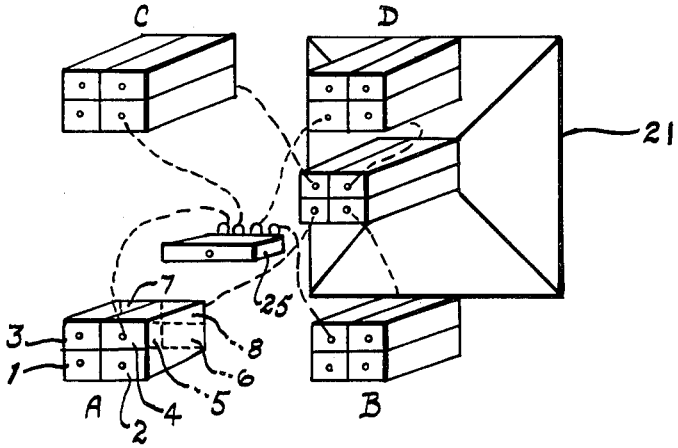
FIG. 4 is a microwave circuit for scanning in two planes.

The circuit of FIG. 4 provides the proper overlap for two planes of scan. In this arrangement four directional couplers labeled A, B, C, D are provided to couple electromagnetic wave power between adjacent dual mode horns 21.

The following analysis demonstrates that the circuit of FIG. 4 provides a separable aperture distribution in each horn so that the skew plane scanning conditions can be predicted from the principal plane design results. FIG. 4 shows a central portion of the control circuitry 25 illuminating a small section of the horn array. Each phased signal (for example, the array center element signal with $e^{j0}$ incident) is divided into four signals with amplitude one-half of the incident signal. These signals are coupled to all other nearest neighbor phased signals by means of directional couplers labeled, A, B, C, and D. Each directional coupler circuit performs, for example, E-plane and H-plane coupling sequentially, so that if the input ports are numbered 1 through 4 as on the drawing, and the output ports are numbered 5 through 8, then the output signals $b_n$ are given in terms of the input signals $a_n$ by the equations:

$$b_5 = T_H(T_E a_1 \; 30 \; C_e a_3) + C_H(T_E a_2 + C_E a_4),$$
$$b_6 = C_H(T_E a_1 + C_E a_3) + T_H(T_E a_2 + C_E a_4),$$
$$b_7 = T_H(C_E a_1 + T_E a_3) + C_H(T_E a_2 + C_E a_4),$$
$$b_8 = C_H(C_E a_1 + T_E a_3) + T_H(T_E a_2 + C_E a_4),$$

where $T_E$ and $T_H$ are the coupler transmission coefficients for $E$ and $H$-planes, and $C_E$ and $C_H$ are the coupling coefficients. For lossless couplers $$|C_E|^2 + |T_E|^2 = 1,$$

and $$|C_H|^2 + |T_H|^2 = 1.$$

The central horn sees only the contribution from terminal 8 of this circuit from the coupler labeled A, but receives inputs from the other couplers, B, C, and D as well. After application of the proper phase progression for the array, these contributions appear in the form below.

$$A: \tfrac{1}{2}(C_H e^{-j\eta_H} + T_H)(C_E e^{-j\eta_E} + T_E),$$
$$B: \tfrac{1}{2}(C_H e^{+j\eta_H} + T_H)(C_E e^{-j\eta_E} + T_E),$$
$$C: \tfrac{1}{2}(C_H e^{-j\eta_H} + T_H)(C_E e^{+j\eta_E} + T_E),$$
$$D: \tfrac{1}{2}(C_H e^{+j\eta_H} + T_H)(C_E e^{+j\eta_E} + T_E),$$

where $\eta_E = 2\pi v = 2\pi (\sin \theta \sin \phi)$ and $\eta_H = 2\pi u = 2\pi \sin \theta \cos \phi$, for a a main beam at the angle $\theta$, $\phi$ as defined in conventional polar coordinates, with $\phi$ measured from the x-axis in the plane $z = 0$, and with the E-plane lying along the y-axis.

Each horn is excited by four waveguide inputs which may include provision for proper impedance matching, and which must include means for adjusting the relative higher order mode phase lengths to obtain the correct phase ratios at the horn aperture. On the assumption that the impedances can be matched properly, the four input terminals excite modes in the horn that are basically $LSE_{10}$, $LSE_{11}$, $LSE_{20}$ and $LSE_{21}$, and the power in each of these modes is proportional to the square of the magnitude of the following expressions:

$$LSE_{10} \rightarrow (T_E + C\cos \eta_E)\, T_H + C_H \cos \eta_H),$$
$$LSE_{11} \rightarrow -j\, C_E \sin \eta_E\, (C_H \cos \eta_H + T_H),$$
$$LSE_{20} \rightarrow -j\, C_H \sin \eta_H\, (C_E \cos \eta_E + T_E),$$
$$LSE_{21} \rightarrow -C_E\, C_H \sin \eta_E \sin \eta_H.$$

Modifications to the horn aperture designed to make the H-plane pattern similar to the E-plane pattern do not alter the E-plane distribution itself, and so the resulting E-plane ($v$) and H-plane ($u$) patterns of the modified horn aperture as excited by the four LSE type modes assume the symmetrical forms below:

$$f_{10}(u, v) = g_e(u) f_e(v),$$
$$f_{11}(u,v) = g_e(u) f_o(v),$$
$$f_{20}(u,v) = g_o(u) f_e(v),$$
$$f_{21}(u,v) = g_o(u) f_o(v),$$

where $g_e$ and $g_o$ are the even and odd H-plane ($u$) far field patterns, and $f_e$ and $f_o$ are the even and odd E-plane ($v$) far field patterns. The relative field strengths for the various modes of radiation are obtained by multiplying the expressions by the square root of the impedance for each mode, so that $LSE_{11}$ mode excites the $F_{11}$ coefficient with amplitude $K_E$, relative to the $F_{10}$ $(u,v)$ term. Similarly, $LSE_{20}$ mode with unity amplitude excites the $F_{21}$ coefficient with amplitude $K_E K_H$ if the waveguide or horn is large enough so that all velocities of propagation are essentially the speed of light. In oversize rectangular waveguides, these constants are: $K_E = K_H = \sqrt{2}$.

The complete far field expression therefore is:

$$F(w,v) = U(u)\, V(v)$$
$$= [(C_r \cos n_E + T_E)\, f_r(v) - j\, K_E C_E \sin n_E\, f_o(v)]$$

-continued $$[(C_H \cos n_H + T_H)\, g_e(u) - j\, K_H C_H \sin n_H\, g_o(u)].$$

This expression, with its separable distribution in direction cosine $(u,v)$ space, indicates that the effective element pattern of the array/network combination is the product of its E-plane element pattern $V(v)$ times its H-plane element pattern $U(u)$. The E-plane excitation is the same as that derived for the E-plane circuit of FIG. 2. Thus, with the H-plane signal distribution, the circuit of FIG. 4 provides the proper element pattern for scanning to all skew angles in the scan sector.

While the invention has been described in one presently preferred embodiment, it is understood that the words which have been used are words of description rather than words of limitation and that changes within the purview of the appended claims may be made without departing from the scope and spirit of the invention in its broader aspects.

What is claimed is:

1. A phased array antenna comprising an array of radiating elements, a sum and difference hybrid connected to the input of each radiating element, a microwave transmission line feed circuit connected to deliver electromagnetic wave power to each sum and difference hybrid, a coupling means associated with each radiating element for coupling discrete amounts of the even and odd mode electromagnetic wave power propagating through the feed circuit of its associated radiating element with the electromagnetic wave power propagating through the feed circuits of each of the nearest adjacent radiating elements, and means for establishing a given phase relationship between even and odd mode power at the aperture of each radiating element.

2. A phased array antenna as defined in claim 1 wherein each radiating element comprises a dual mode antenna horn.

3. A phased array antenna as defined in claim 2 wherein each said sum and difference hybrid comprises a dual mode waveguide junction.

4. A phased array antenna as defined in claim 3 wherein the phase relationship between even and odd mode power at each dual mode antenna horn aperture is established by antenna horn and dual mode waveguide junction length dimensions that effect a 90°phase delay of the odd mode power propagating therethrough.

* * * * *